US009526938B2

(12) United States Patent
Chen

(10) Patent No.: US 9,526,938 B2
(45) Date of Patent: Dec. 27, 2016

(54) MULTIFUNCTIONAL LEG TRAINING MACHINE

(71) Applicant: JOONG CHENN INDUSTRY CO., LTD., Nantou, Nantou County (TW)

(72) Inventor: James Chen, Nantou (TW)

(73) Assignee: JOONG CHENN INDUSTRY CO., LTD., Nantou, Nantou County (TW)

( * ) Notice: Subject to any disclaimer, the term of this patent is extended or adjusted under 35 U.S.C. 154(b) by 0 days.

(21) Appl. No.: 14/594,904

(22) Filed: Jan. 12, 2015

(65) Prior Publication Data

US 2016/0144218 A1 May 26, 2016

(30) Foreign Application Priority Data

Nov. 24, 2014 (TW) ..... 103140635 A

(51) Int. Cl.

| | |
|---|---|
| ***A63B 21/06*** | (2006.01) |
| ***A63B 21/078*** | (2006.01) |
| ***A63B 21/062*** | (2006.01) |
| ***A63B 23/04*** | (2006.01) |

(52) U.S. Cl.

CPC ..... *A63B 21/062* (2013.01); *A63B 23/0405* (2013.01); *A63B 2023/0411* (2013.01)

(58) Field of Classification Search

CPC ..... A63B 21/00; A63B 21/06; A63B 21/062–21/0628; A63B 21/0601–21/0609; A63B 21/063; A63B 21/0632; A63B 21/078; A63B 21/0783; A63B 23/0405; A63B 2023/0411

USPC ..... 482/92–94, 98, 104

See application file for complete search history.

(56) References Cited

U.S. PATENT DOCUMENTS

| | | | | | |
|---|---|---|---|---|---|
| 4,795,149 | A * | 1/1989 | Pearson | A63B 21/078 | 482/133 |
| 4,856,773 | A * | 8/1989 | Deola | A63B 21/0628 | 482/102 |
| 5,050,868 | A * | 9/1991 | Pearson | A63B 21/0615 | 482/104 |
| 5,215,510 | A * | 6/1993 | Baran | A63B 21/0626 | 482/104 |
| 5,569,133 | A * | 10/1996 | Vittone | A63B 21/078 | 482/135 |
| 5,669,859 | A * | 9/1997 | Liggett | A63B 21/0626 | 482/101 |
| 5,957,818 | A * | 9/1999 | Betournay | A63B 21/065 | 482/105 |
| 6,802,800 | B1 * | 10/2004 | Hobson | A63B 21/0615 | 482/137 |
| 7,066,866 | B1 * | 6/2006 | Mobley | A63B 1/00 | 482/40 |

(Continued)

*Primary Examiner* — Stephen Crow
*Assistant Examiner* — Garrett Atkinson
(74) *Attorney, Agent, or Firm* — Muncy, Geissler, Olds & Lowe, P.C.

(57) ABSTRACT

A multifunctional leg training machine includes a framework, a weight-bearing mechanism mounted at said framework and movable in direction toward or away from said framework and adapted to impart a downward pressure to the shoulders of the user using the machine, allowing the user to perform a squat exercise, a lunge exercise, a calf-raise exercise, a simple transverse body movement exercise, or a mixed training exercise of moving the body transversely and upwardly to fully train different muscle groups of the legs.

10 Claims, 15 Drawing Sheets

(56) References Cited

U.S. PATENT DOCUMENTS 7,112,164 B1 * 9/2006 Hoagland ..... A63B 21/0724 482/106
7,131,937 B2 * 11/2006 Skilken ..... A63B 21/0626 482/101
7,374,516 B2 * 5/2008 Lundquist ..... A63B 21/0783 482/104
7,455,629 B2 * 11/2008 Abelbeck ..... A63B 21/078 482/101
7,488,277 B1 * 2/2009 Knapp ..... A63B 21/078 482/104
7,608,020 B2 * 10/2009 Mason ..... A63B 21/0615 482/105
7,666,124 B2 * 2/2010 Vaes ..... A63B 21/078 482/101
7,713,179 B2 * 5/2010 Webber ..... A63B 21/078 482/104
7,815,555 B2 * 10/2010 Webber ..... A63B 21/0618 482/104
7,909,743 B1 * 3/2011 Webber ..... A63B 21/078 482/104
8,088,018 B2 * 1/2012 Melville ..... A63B 69/0057 473/227
8,337,370 B2 * 12/2012 Rogers ..... A63B 21/078 482/104
8,500,608 B1 * 8/2013 Bonomi ..... A63B 21/062 482/101
9,011,298 B2 * 4/2015 Bonomi ..... A63B 21/0414 482/101
9,067,102 B2 * 6/2015 Poppinga ..... A63B 21/078
2002/0098953 A1 * 7/2002 Scheewe ..... A63B 21/06 482/94
2006/0252609 A1 * 11/2006 Abelbeck ..... A63B 21/078 482/92
2006/0252612 A1 * 11/2006 Melcer ..... A63B 21/078 482/94
2013/0184128 A1 * 7/2013 Towley, III ..... A63B 21/0628 482/102
2013/0203565 A1 * 8/2013 Floyd ..... A63B 21/078 482/102
2014/0128228 A1 * 5/2014 Bonomi ..... A63B 21/0414 482/98

* cited by examiner

MULTIFUNCTIONAL LEG TRAINING MACHINE

BACKGROUND OF THE INVENTION

1. Field of the Invention

The present invention relates to exerciser technology and more particularly, to a multifunctional leg training machine.

2. Description of the Related Art

A typical leg exercise, such as squat, is normally trained using a weightlifting rack, however, it should be very careful when using a weightlifting rack to do a lunge or calf-raise exercise.

In early weight training, the barbell is directly carried on the shoulders. This method can simply do the conventional parallel squat exercise to train the muscles of the legs. However, because there is no any safety facilities used in the training, the user can be crushed by the barbell if the user is unable to withstand the load, or a poor training posture can lead to injuries of the waist, spine or knees.

Recently, Smith machines are widely used for a wide variety of exercises. A Smith machine generally comprises two upward bars arranged at two opposite lateral sides of a framework in a parallel manner, two sliding sleeves respectively slidably coupled to the upward bars, and a barbell fixedly connected between the sliding sleeves for upward movement without vibration. However, this kind of weight-lifting training machine can simply allow the user to lift weight upwardly, it is practical for training different muscle groups of the legs.

SUMMARY OF THE INVENTION

The present invention has been accomplished under the circumstances in view. It is the main object of the present invention to provide a multifunctional leg training machine, which has a weight-bearing mechanism mounted at the framework thereof and movable in direction toward or away from the framework and adapted to impart a downward pressure to the shoulders of the user using the machine, allowing to the user to perform a squat exercise, a lunge exercise, a calf-raise exercise, a simple transverse body movement exercise, or a mixed training exercise of moving the body transversely and upwardly to fully train different muscle groups of the legs.

To achieve this and other objects of the present invention, a multifunctional leg training machine of the invention comprises a framework placed on a bearing surface, and a weight-bearing mechanism mounted in the framework and movable relative to the framework in direction toward or away from the framework. The weight-bearing mechanism comprises a longitudinal sliding device set upwardly mounted in the framework and movable between opposing top and bottom sides of the framework, a transverse sliding device set slidably coupled to the longitudinal sliding device set and movable between opposing left and right sides of the framework, and a plurality of weight plates mountable at the longitudinal sliding device set to impart a downward pressure to the longitudinal sliding device set so that when a user carries the weight-bearing mechanism with the shoulders, the weight plates give a downward pressure to the user.

Preferably, the longitudinal sliding device set comprises two upward bars respectively upwardly affixed to opposing left and right sides of the framework, two sliding sleeves respectively sleeved onto the upward bars and respectively axially movable along the upward bars, and a sliding bar connected between the two sliding sleeves for allowing the transverse sliding device set to slide thereon.

Preferably, the longitudinal sliding device set comprises two pairs of upward bars, two sliding sleeve sets, and a sliding bar connected between the sliding sleeve sets. The upward bars are symmetrically fixedly mounted at opposing left and right sides of the framework. The sliding sleeve sets are respectively coupled to the upward bars and axially movable relative to the upward bar. The sliding bar has two opposite ends thereof respectively fixedly connected to the sliding sleeve sets for allowing the transverse sliding device set to slide thereon.

Preferably, each sliding sleeve set comprises a link and two sliding sleeves. The sliding sleeves is respectively fixedly connected to two opposite ends of the link and respectively slidably sleeved onto respective upward bars. The sliding bar has two opposite ends thereof respectively fixedly connected to the links of the two sliding sleeve sets.

Preferably, the longitudinal sliding device set further comprises a stretcher bar fixedly connected between the links of the two sliding sleeve sets.

Preferably, the longitudinal sliding device set further comprises a hanging rod connected to each sliding sleeve and extending toward the sliding bar for hanging the weight plates.

Preferably, the transverse sliding device set comprises a pulley holder frame, a plurality of pulleys, a cushion set and two grips. The pulleys are rotatably mounted in the pulley holder frame at two opposite sides relative to the sliding bar. The cushion set is fixedly mounted at the pulley holder frame for stopping at the shoulders of the user operating the multifunctional leg training machine. The grips are affixed to the pulley holder frame and respectively disposed near the user's shoulders for holding by the user.

Preferably, the sliding bar is a rhombic tube having four slanted sides. Each two adjacent slanted sides are connected together to create a V-shaped sliding rail. Further, each pulley defines therein a V-shaped sliding groove fitting the V-shaped sliding rail.

Preferably, the cushion set comprises two pivot members and a cushion member. The pivot members are fixedly connected to a bottom side of the pulley holder frame. The cushion member is pivotally coupled between the two pivot members.

Preferably, the multifunctional leg training machine further comprises two positioning mechanisms respectively mounted at the sliding bar of the longitudinal sliding device set near the framework for positioning the weight-bearing mechanism in the framework at a predetermined elevation.

Preferably, the framework comprises two upright posts disposed at two opposite lateral sides thereof and upwardly upwardly extended from a bottom side thereof, and a plurality of positioning rods located at each upright post at different elevations. Each positioning mechanism comprises a connection member, a handle and a hook member. The connection member is fixedly connected to the sliding bar. The handle is pivotally connected to the connection member. The hook member is biasable by the handle in two reversed directions to hook on the positioning rod or to release the positioning rod.

Preferably, the hook members of the two positioning mechanisms are connected together by a link for enabling the two positioning mechanisms to be moved synchronously.

Preferably, the multifunctional leg training machine further comprises two buffering mechanisms. Each buffering mechanism comprises a buffer sleeve, a grip and a clamping hook. The buffer sleeve is axially slidably and rotatably sleeved onto one respective upward bar. The grip of each buffering mechanism is fixedly connected to the buffer sleeve. The clamping hook is biasable by the grip of the respective buffering mechanism in two reversed directions to hook on the positioning rod or to release the positioning rod.

Preferably, the framework further comprises two support posts disposed at two opposite lateral sides thereof and upwardly extended from a bottom side thereof, and a plurality of hanging rods located at each support post at different elevations for hanging the weight plates.

Thus, the multifunctional leg training machine allows the user to perform a squat exercise, a lunge exercise, a calf-raise exercise, a simple transverse body movement exercise, or a mixed training exercise of moving the body transversely and upwardly to fully train different muscle groups of the legs.

Other advantages and features of the present invention will be fully understood by reference to the following specification in conjunction with the accompanying drawings, in which like reference signs denote like components of structure.

DETAILED DESCRIPTION OF THE INVENTION

Figure 1:
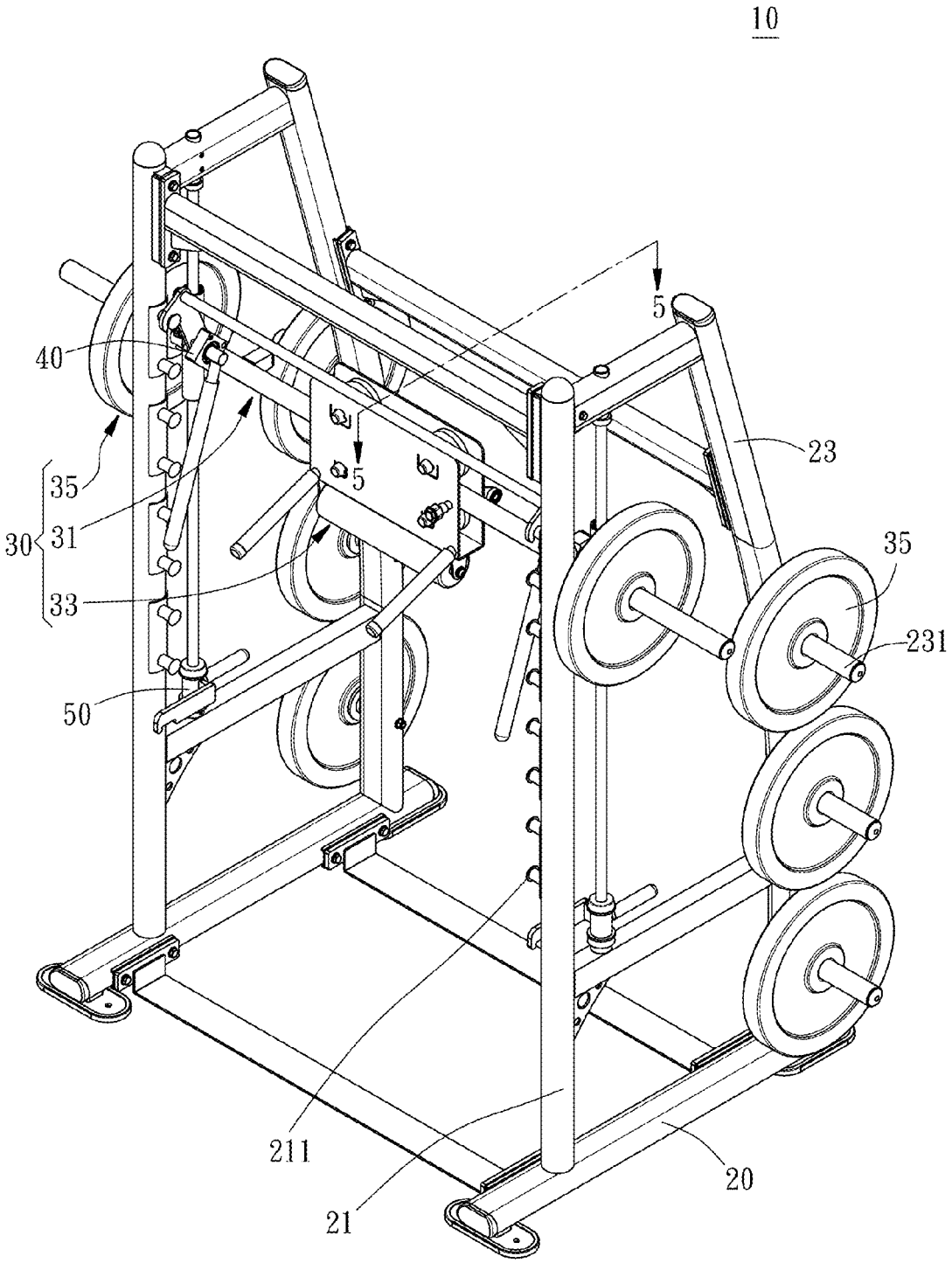
FIG. 1 is an oblique top elevational view of a multifunctional leg training machine in accordance with a first embodiment of the present invention.

Referring to FIGS. 1-5, a multifunctional leg training machine 10 in accordance with a first embodiment of the present invention is shown. The multifunctional leg training machine 10 comprises a framework 20, a weight-bearing mechanism 30, two positioning mechanisms 40, and two buffering mechanisms 50.

The framework 20 is placed on a bearing surface (floor), comprising two upright posts 21 and two support posts 23 located at two opposite lateral sides thereof and upwardly extended from the floor. Preferably, the upright posts 21 are bilaterally disposed at a front side, and the support ports 23 are bilaterally disposed at an opposing rear side. The framework 20 further comprises a row of positioning rods 211 located at each upright post 21 at an inner side and spaced along the length thereof at a predetermined interval, and a row of hanging rods 231 located at each support post 23 at an outer side and spaced along the length thereof at a predetermined interval for hanging weight plates (iron discs) 35. It is to be understood that the number and locations of the positioning rods 211 and the hanging rods 231 shown in the drawings are for the purpose of illustration only but not intended for use to limit the scope of the invention. Alternatively, the positioning rods 211 or the hanging rods 231 can be located at only one upright post 21 or one support post 23.

Figure 2:
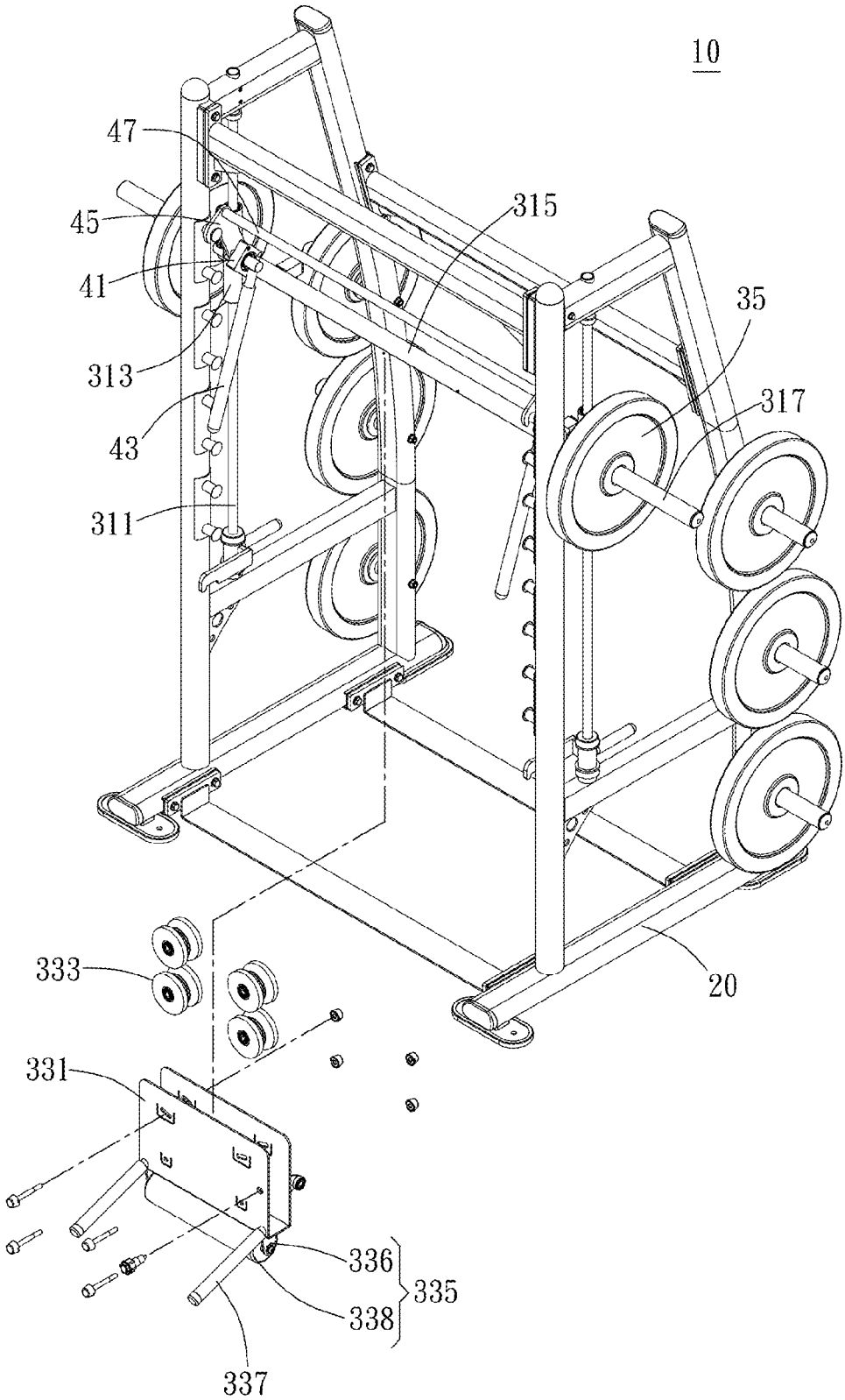
FIG. 2 is an exploded view of the multifunctional leg training machine in accordance with the first embodiment of the present invention, illustrating the components of the transverse sliding device set and their relative positioning.
Figure 3:
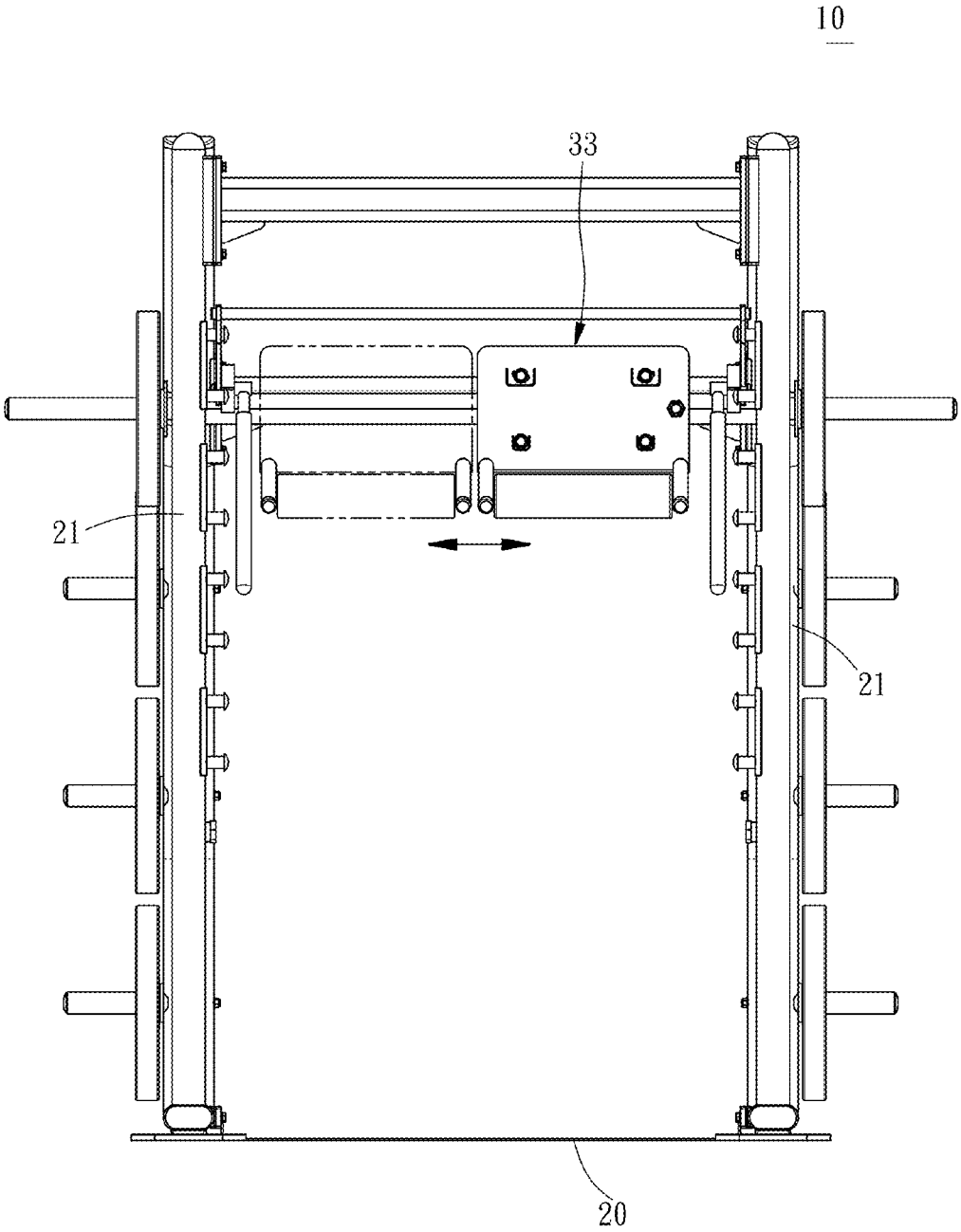
FIG. 3 is a schematic front view of the multifunctional leg training machine in accordance with the first embodiment of the present invention, illustrating the transverse sliding device set moved transversely along the sliding bar.
Figure 5:
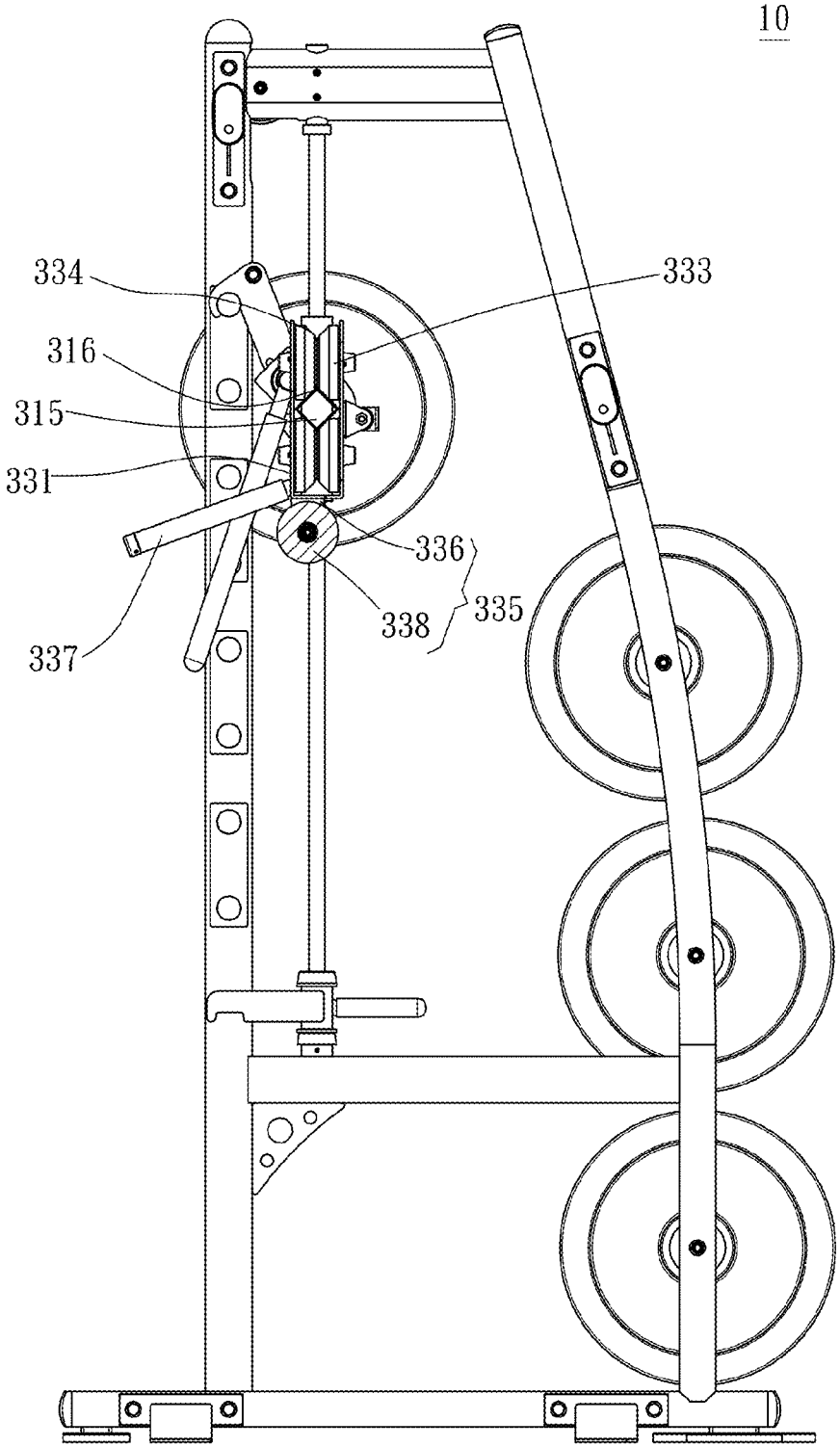
FIG. 5 is a schematic sectional view of the multifunctional leg training machine in accordance with the first embodiment of the present invention, illustrating the relationship between the longitudinal sliding device set and the transverse sliding device set.

The weight-bearing mechanism 30 is mounted at the framework 20, and can be moved toward or away from the framework 20. The weight-bearing mechanism 30 can provide a weight. When the user carries the weight-bearing mechanism 30 with the shoulders, the gravity of weight of the weight-bearing mechanism 30 is applied to the user. As illustrated in FIGS. 2 and 3, the weight-bearing mechanism 30 comprises a longitudinal sliding device set 31, a transverse sliding device set 33, and the aforesaid weight plates 35. The longitudinal sliding device set 31 is upwardly mounted in the framework 20, and can be moved relative to the framework 20 between opposing top and bottom sides thereof. The transverse sliding device set 33 is slidably coupled to the longitudinal sliding device set 31, and can be moved relative to the framework 20 between the two opposite lateral sides thereof. The user can selectively attach a predetermined number of the weight plates 35 to two opposite sides of the longitudinal sliding device set 31 to give a downward pressure. The weight plates 35 that are not selected can be hung on the hanging rods 231 of the support posts 23. More specifically, the longitudinal sliding device set 31 comprises two upward bars 311, two sliding sleeves 313, a sliding bar 315 connected between the sliding sleeves 313, and two hanging rods 317. The upward bars 311 are respectively affixed to the opposing left and right sides of the framework 20. The sliding sleeves 313 are respectively sleeved onto the upward bars 311 and movable axially up and down along the upward bars 311. The sliding bar 315 has two opposite ends thereof respectively fixedly connected to the sliding sleeves 313. The transverse sliding device set 33 is slidably coupled to the sliding bar 315. The hanging rods 317 are respectively outwardly extended from the sliding sleeves 313 in direction away from the sliding bar 315 for supporting the weight plates 35. The transverse sliding device set 33 comprises a pulley holder frame 331, a plurality of pulleys 333, a cushion set 335, and two grips 337. The pulleys 333 are rotatably mounted in the pulley holder frame 331, and bilaterally symmetrically disposed at different elevations. The cushion set 335 is fixedly mounted at a bottom side of the pulley holder frame 331 for supporting on the user's shoulders. The grips 337 are fixedly connected to the pulley holder frame 331, and respectively disposed corresponding to the user's two shoulders for gripping by the user's hands. Referring also to FIG. 5, in this embodiment, there are four pulleys 333; two pulleys 333 are arranged in parallel above the sliding bar 315; the other two pulleys 333 are arranged in parallel below the sliding bar 315 are respectively disposed in alignment with the two top-sided pulleys 33. The sliding bar 315 is a rhombic tube having four slanted sides, and each two adjacent slanted sides of the sliding bar 315 are connected together to create a V-shaped sliding rail 316. Each pulley 333 defines therein a V-shaped sliding groove 334 mating with the V-shaped sliding rail 316. Thus, the pulleys 333 can be moved smoothly and stably along the sliding bar 315.

The cushion set 335 comprises two pivot members 336 and a cushion member 338. The pivot members 336 are fixedly mounted at the bottom side of the pulley holder frame 331. The cushion member 338 is pivotally coupled between the two pivot members 336. In this embodiment, the cushion member 338 is a cylindrical cushion rotatably supported on the pivot members 336 and adapted to reduce the burden given by the gravity weight of the weight plates 35 to the user's shoulders during training, preventing sports injuries.

Figure 4:
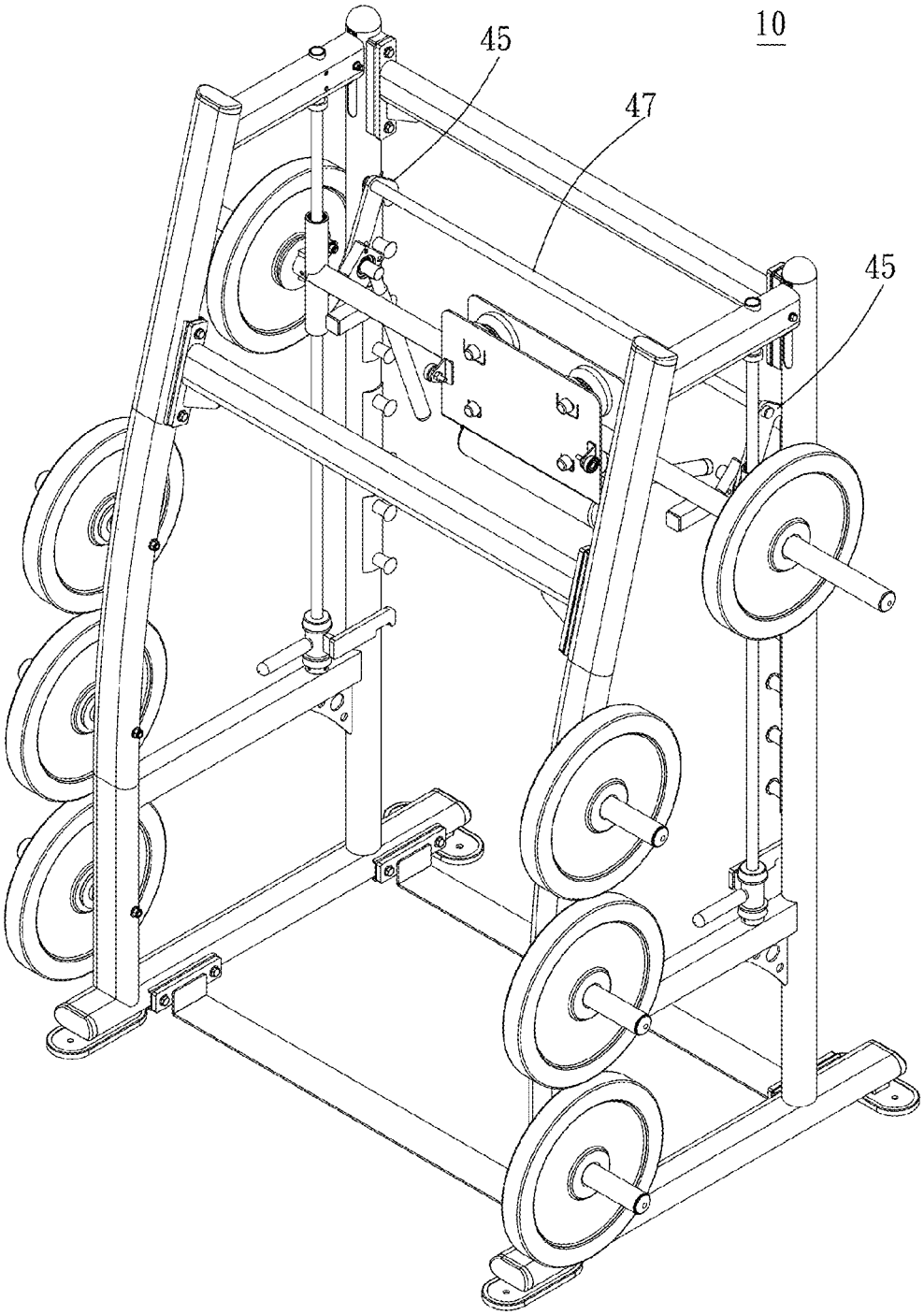
FIG. 4 corresponds to FIG. 1 when viewed from another angle.
Figure 6A:
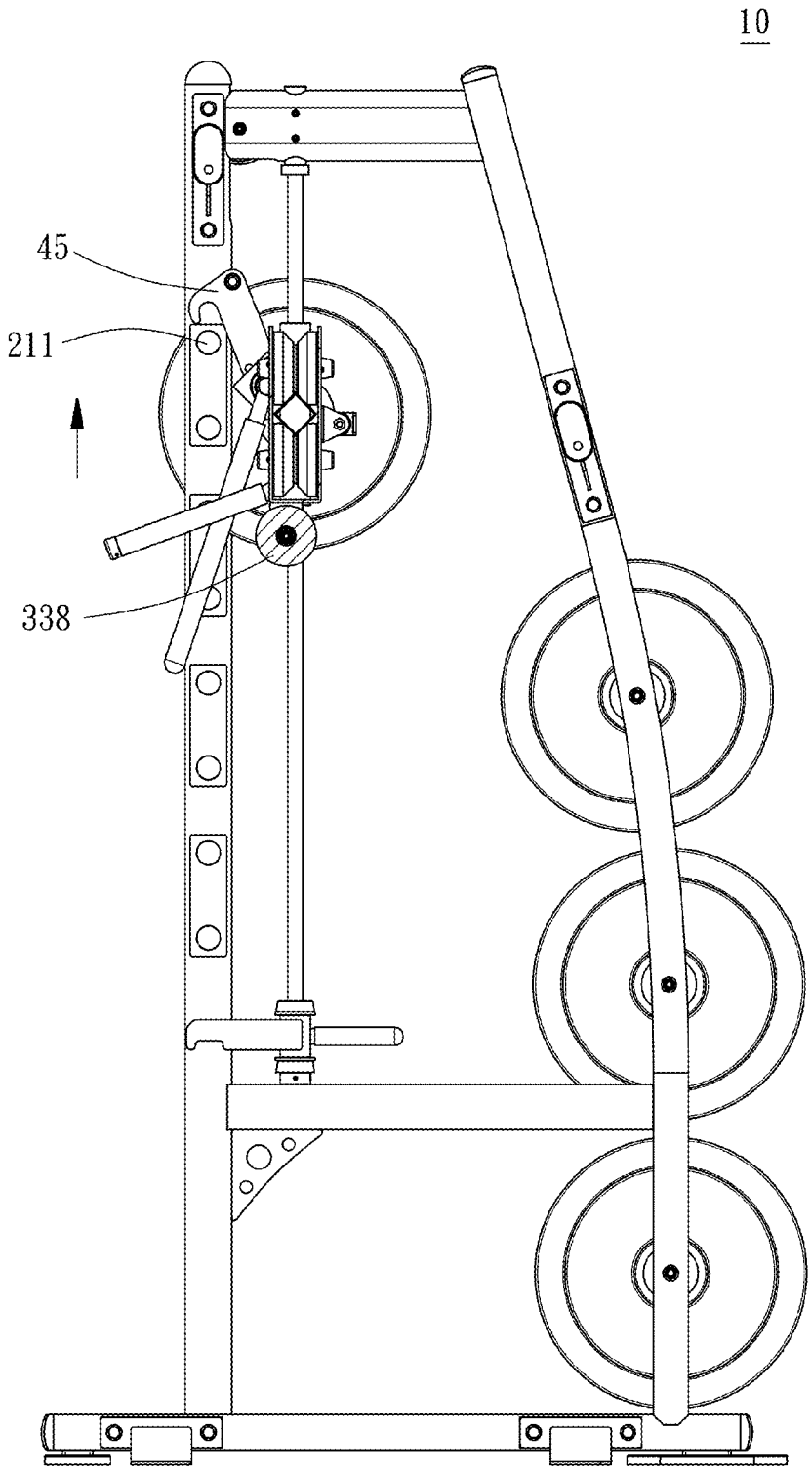
FIGS. 6A and 6B are schematic sectional view of the multifunctional leg training machine in accordance with the first embodiment of the present invention, illustrating the operation of the positioning mechanisms.
Figure 6B:
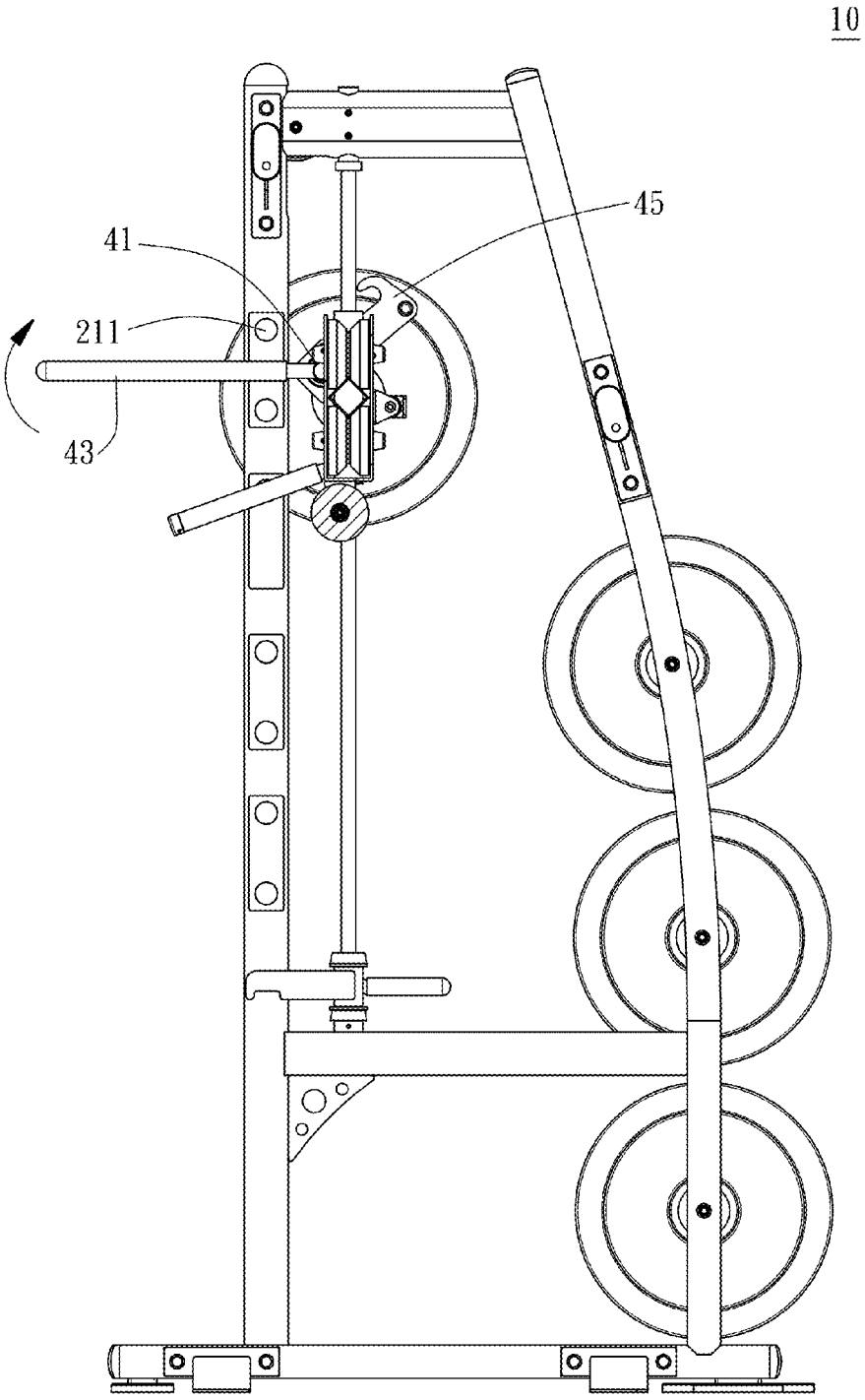

The positioning mechanisms 40 are mounted at the sliding bar 315 of the longitudinal sliding device set 31 adjacent to the two opposite lateral sides of the framework 20 for securing the weight-bearing mechanism 30 to the framework 20 at a specific elevational position. Referring alto to FIGS. 2 and 4, more specifically, each positioning mechanism 40 comprises a connection member 41, a handle 43, and a hook member 45. The connection member 41 is fixedly connected to the sliding bar 315 of the longitudinal sliding device set 31. The handle 43 is pivotally connected to the connection member 41. The hook member 45 is biasable by the handle 43 to hook on or move away from the positioning rod 211. Further, in this embodiment, two positioning mechanisms 40 are provided. For enabling the two hook members 45 to be moved synchronously, a link 47 is connected between the two hook members 45. Thus, the two positioning mechanisms 40 can be moved together. With respect to the operation of the positioning mechanisms 40, as shown in FIG. 6A, before operating the multifunctional leg training machine 10, attach the shoulders to the cushion member 338 and push the cushion member 338 upwards with the shoulders to lift the longitudinal sliding device set 31 and to disengage the hook members 45 from the positioning rods 211, and then, as shown in FIG. 6B, hold the handles 43 with the two hands and push the handles 43 forwards, thereby turning the handles 43 upwardly about the associating connection members 41. At this time, the hook members 45 are moved by the associating handles 43 in direction away from the positioning rods 211 till that the hook members 45 do not collide with the corresponding positioning rods 211.

Figure 7A:
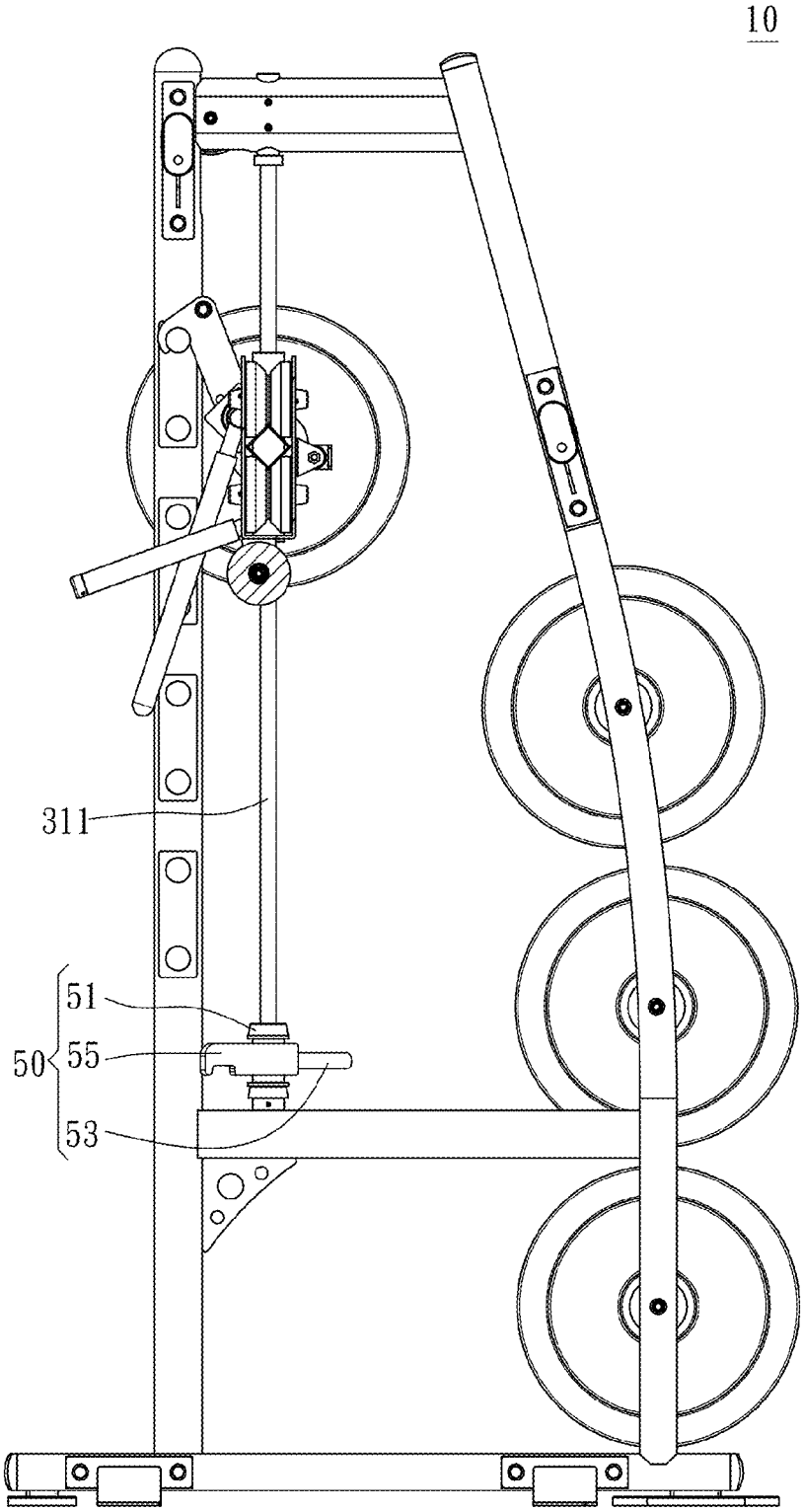
FIGS. 7A through 7C are schematic sectional view of the multifunctional leg training machine in accordance with the first embodiment of the present invention, illustrating the operation of the buffering mechanisms.
Figure 7B:
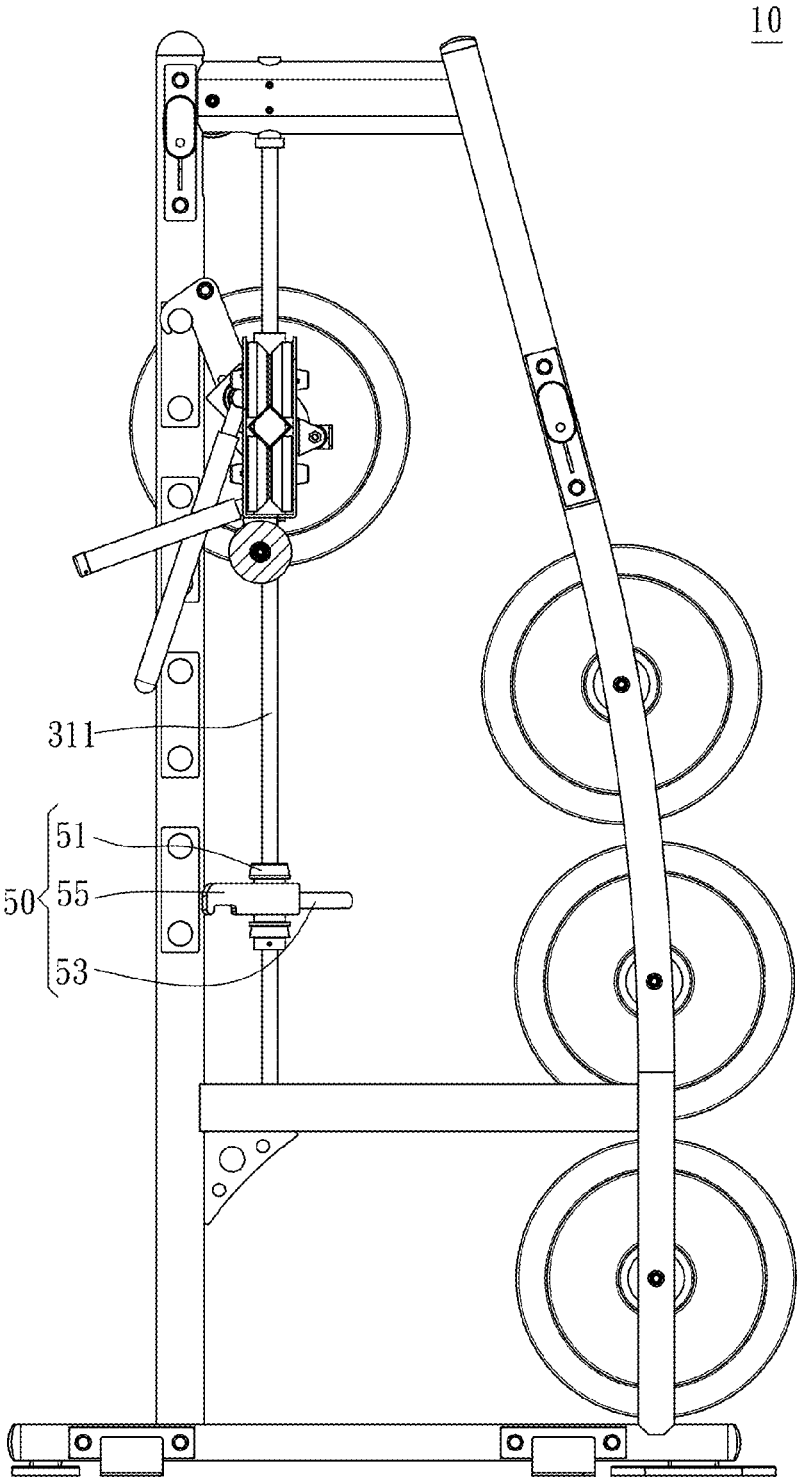
Figure 7C:
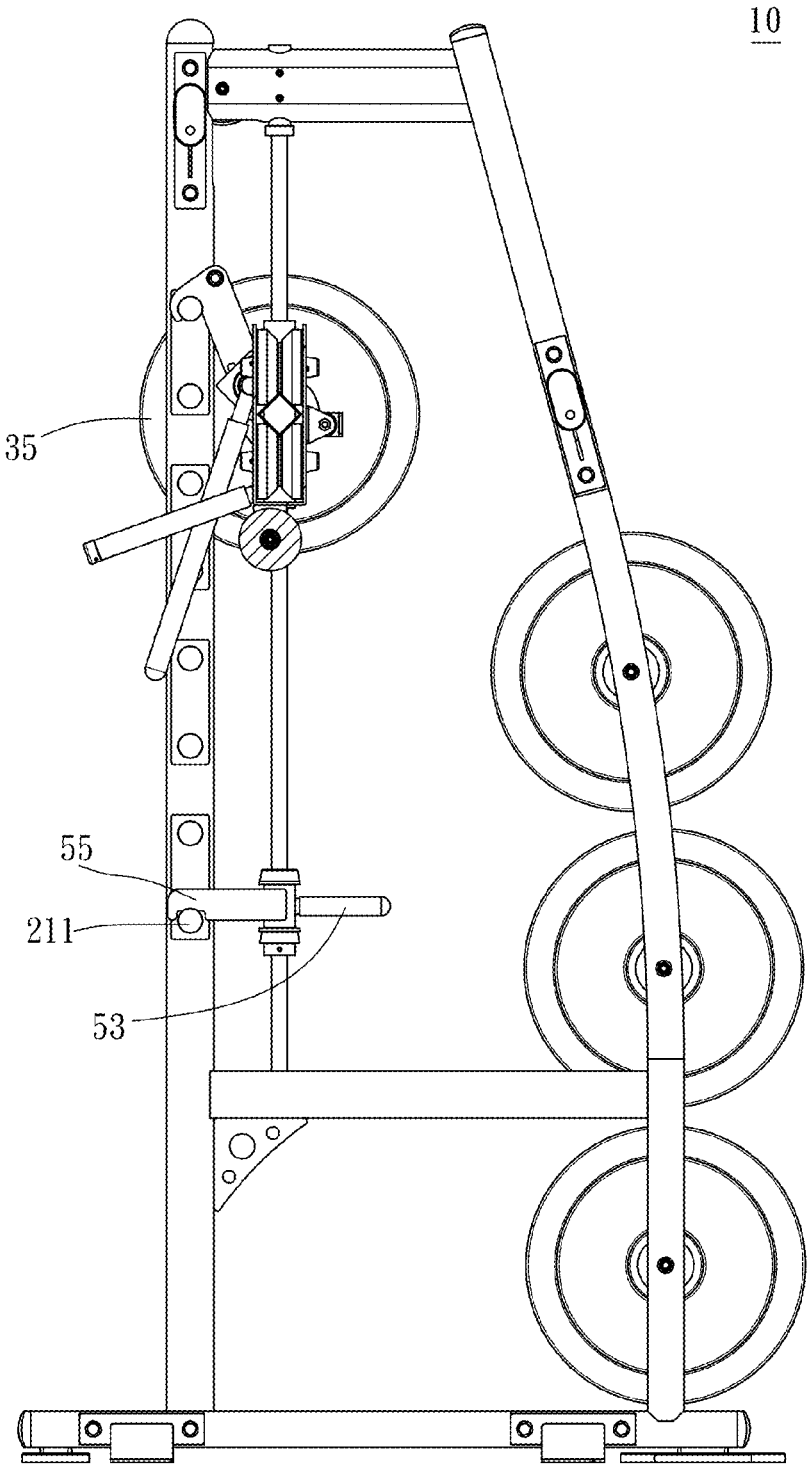

The buffering mechanisms 50, as shown in FIGS. 7A through 7C, each comprise a buffer sleeve 51, a grip 53, and a clamping hook 55. The buffer sleeve 51 is slidably sleeved onto the upward bar 311 and rotatable about the axis of the upward bar 311. The grip 53 is affixed to the buffer sleeve 51. The clamping hook 55 is movable by the grip 53 to turn about the upward bar 311 into engagement with or away from a selected positioning rod 211. Thus, if the longitudinal sliding device set 31 drops down with the weight plates 35 accidentally in the exercise due to user fatigue or lack of muscle strength, the buffering mechanisms 50 can timely let the longitudinal sliding device set 31 be stopped above the floor at a certain height, preventing direct falling of the weight-bearing mechanism 30 to the floor to crush the user.

Figure 8A:
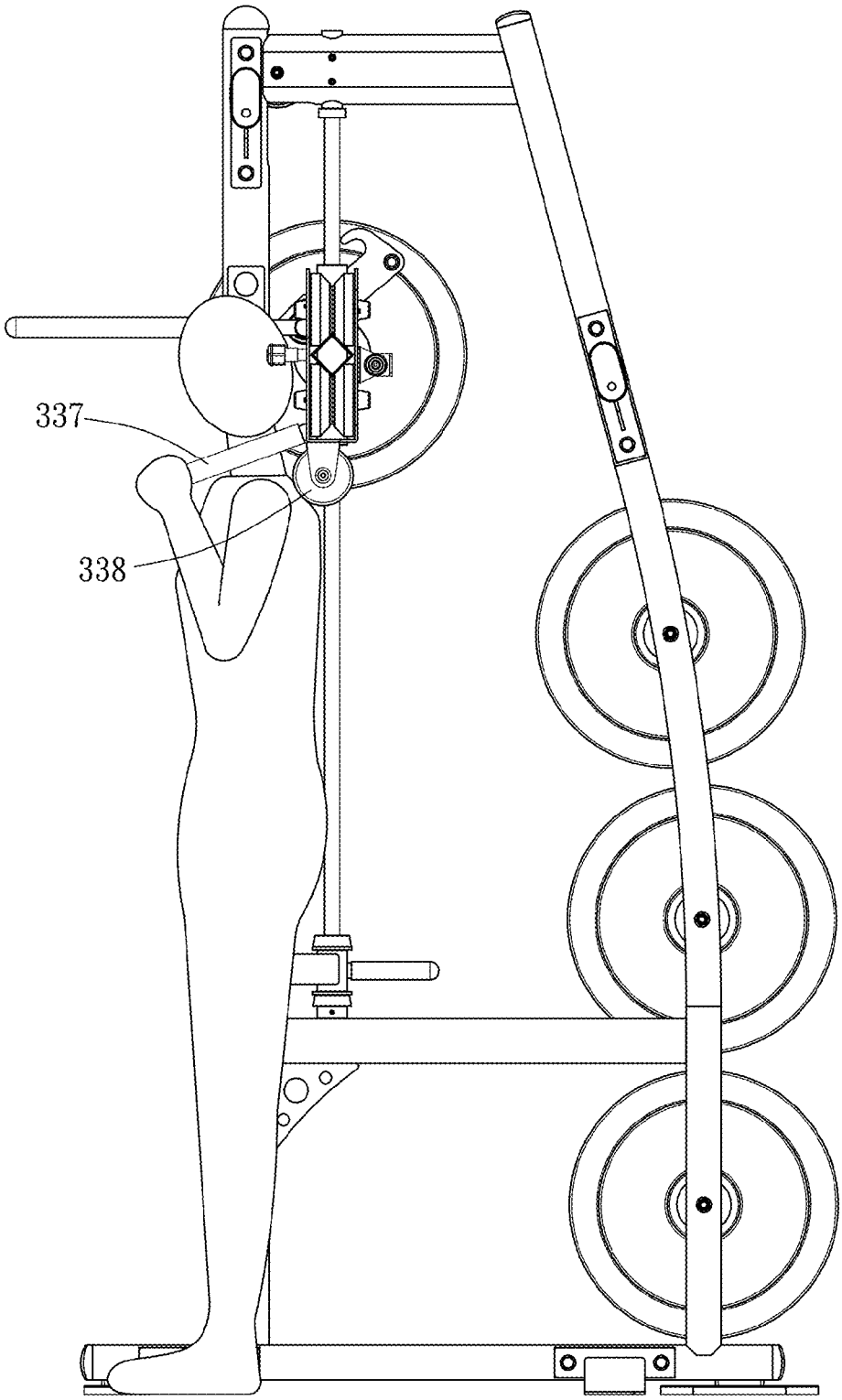
FIGS. 8A through 8D are schematic sectional view of the multifunctional leg training machine in accordance with the first embodiment of the present invention, illustrating the performance of a squat exercise, lunge exercise or calf-raise exercise.
Figure 8B:
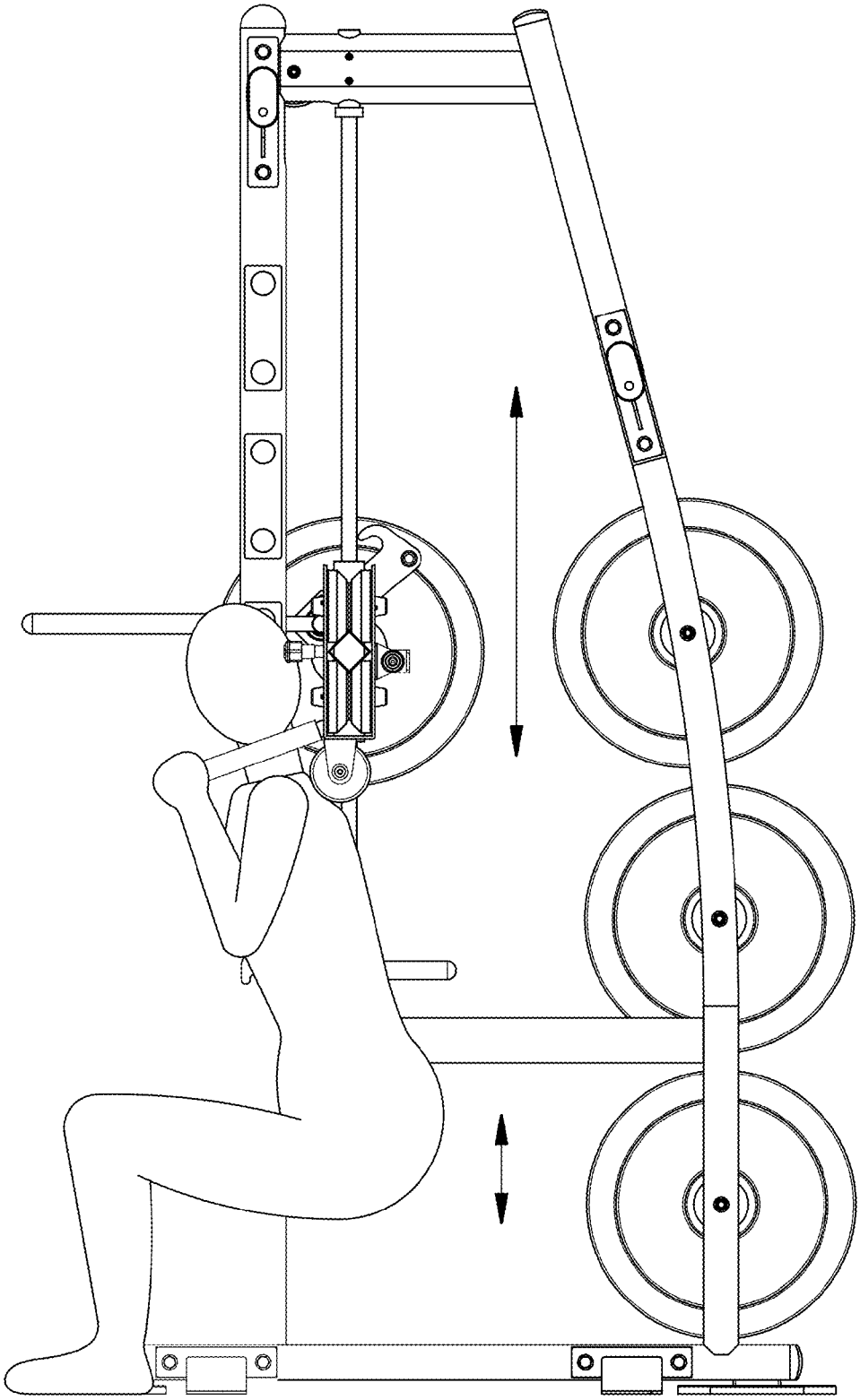
Figure 8C:
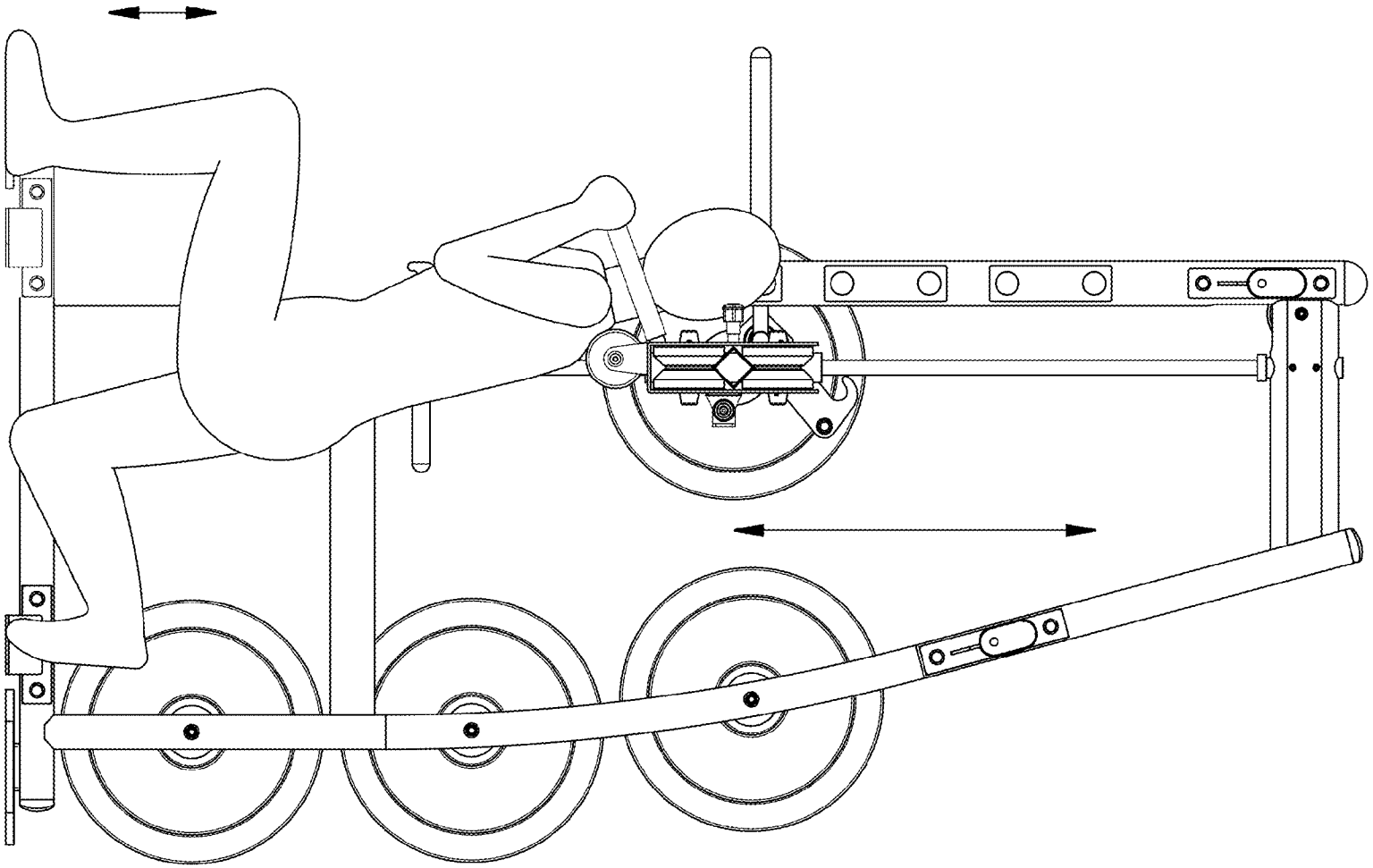
Figure 8D:
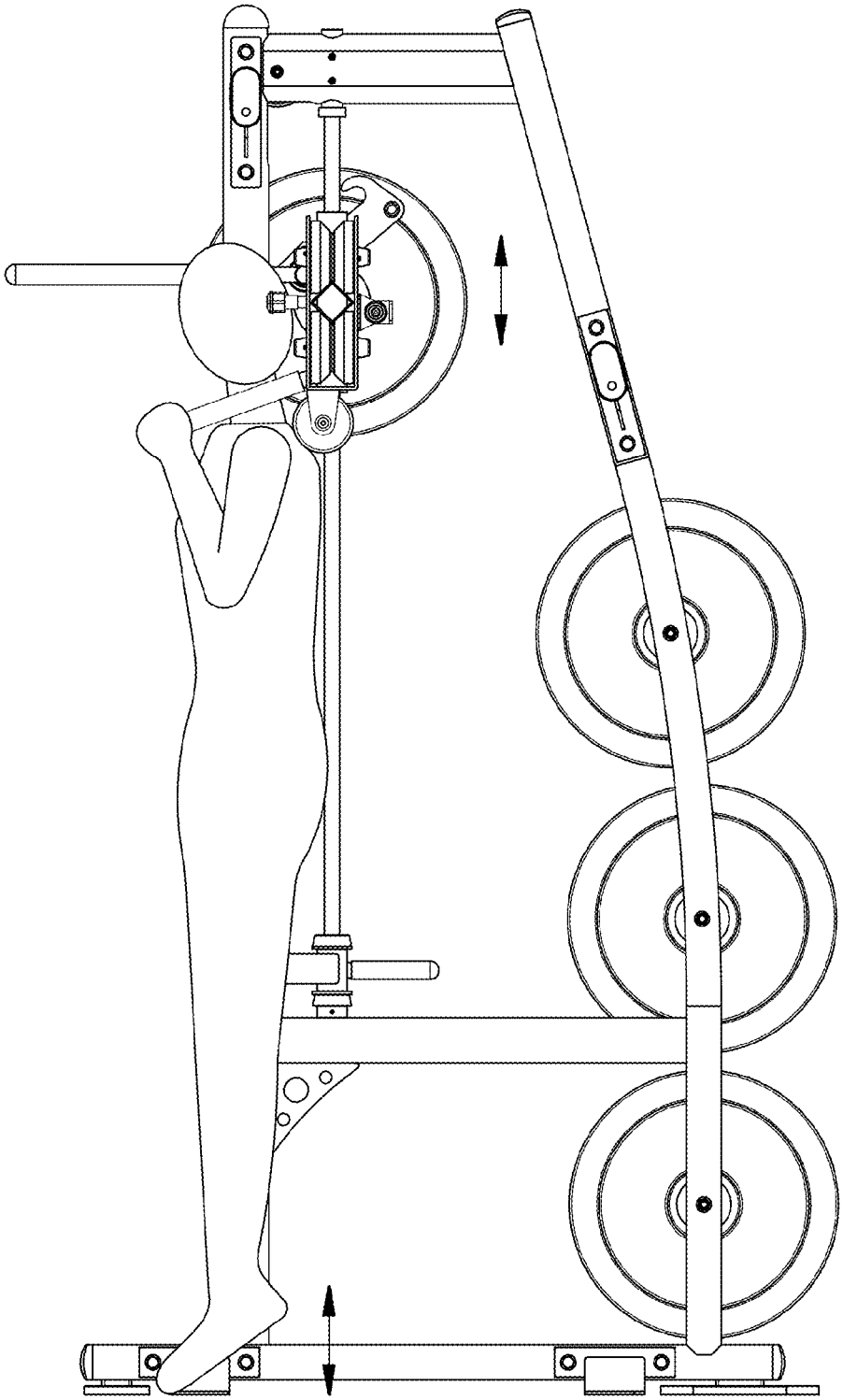

After set the buffering mechanisms 50, the user can then operate the multifunctional leg training machine 10 to train different muscle groups of the legs, as shown in FIG. 8A. At the initial stage, the user stands up in the multifunctional leg training machine 10 with the shoulders stopped at the bottom side of the cushion member 338 and the both hands holding the grips 336, thereafter, as shown in FIG. 8B, the user bends the knees to get into the squat position so as to train the quadriceps muscles, gluteal muscles and the back muscles of the legs, or, as shown in FIG. 8C, the user can get into the lunge position where one leg is positioned forward with knee bent and foot flat on the ground while the other leg is positioned behind to train the muscles of the thighs and buttocks, or, as shown in FIG. 8D, the user can get into the calf-raise position to exercise the gastrocnemius, tibialis posterior and soleus muscles of the lower legs. Of course, also as shown in FIG. 3, the user can operate the longitudinal sliding device set 31 and transverse sliding device set 33 of the weight-bearing mechanism 30 of the multifunctional leg training machine 10 to perform a simple body exercise by moving the body transversely, or to perform a mixed training exercise by moving the body transversely as well as upwardly, and thus, the invention lets the training mode be more varied, and allows the user exercise different muscle groups of the legs.

Figure 9:
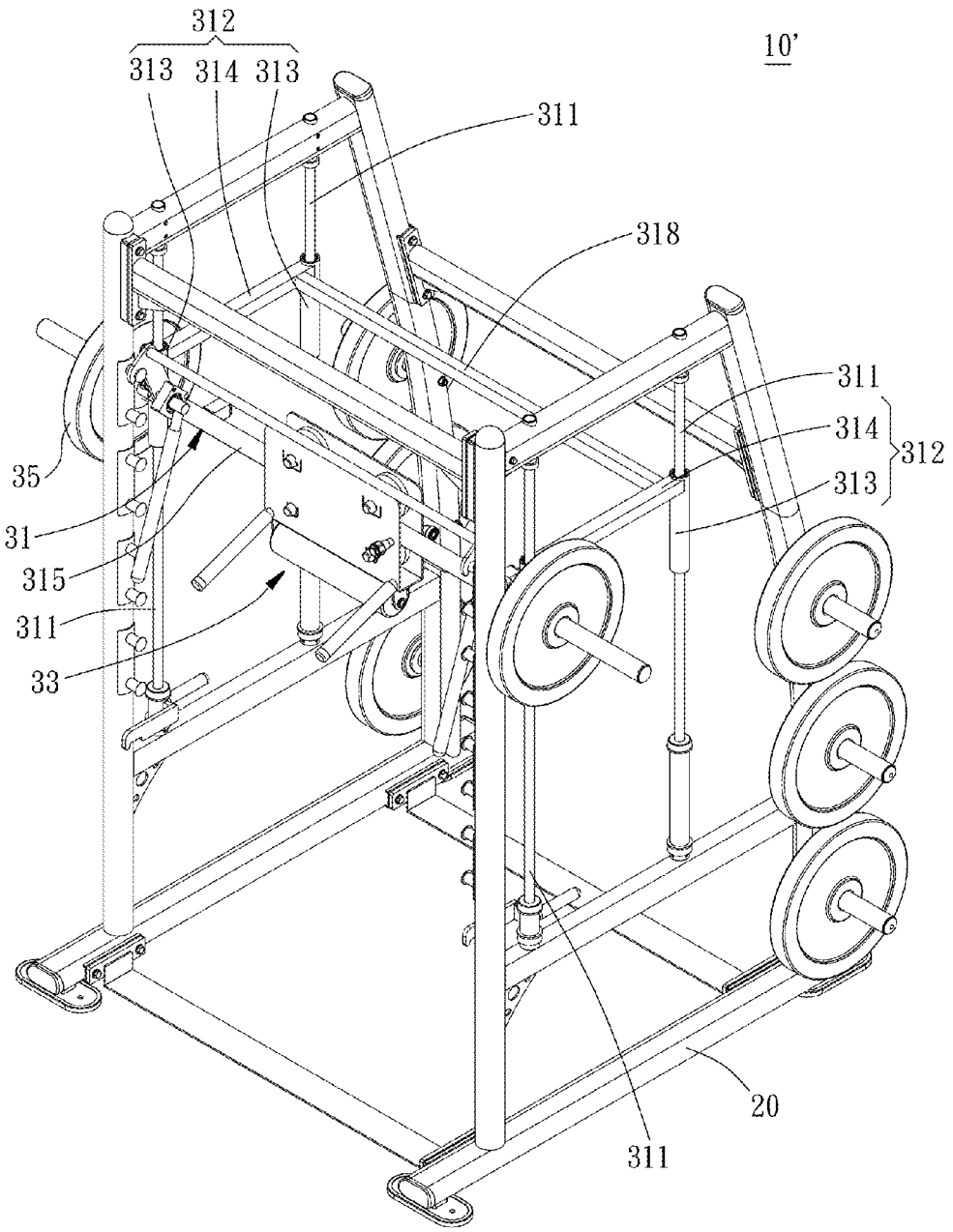
FIG. 9 is an oblique top elevational view of a multifunctional leg training machine in accordance with a second embodiment of the present invention.

Referring to FIG. 9, a multifunctional leg training machine 10' in accordance with a second embodiment of the present invention is shown. This second embodiment is substantially similar to the aforesaid first embodiment with the exception that the longitudinal sliding device set 31 of this second embodiment comprises two pairs of upward bars 311, two sliding sleeve sets 312, and a sliding bar 315 connected between the two sliding sleeve sets 312. The upward bars 311 are respectively symmetrically affixed to the opposing left and right sides of the framework 20. The sliding sleeve sets 312 are respectively coupled to the upward bars 311 and axially movable relative to the upward bars 311. The sliding bar 315 has two opposite ends thereof respectively fixedly connected to the sliding sleeve sets 312 for the sliding of the transverse sliding device set 33. More specifically, each sliding sleeve set 312 comprises two sliding sleeves 313 and a link 314. The two sliding sleeves 313 are respectively and fixedly connected to the two opposite ends of the link 314, and respectively sleeved onto the respective upward bars 311. The sliding bar 315 has the two opposite ends thereof respectively fixedly connected to the links 314 of the sliding sleeve sets 312. Thus, this second embodiment enhances the stability of the upward and downward movement of the longitudinal sliding device set 31 in the framework 20. In order to avoid deformation of the sliding bar 315 due to overweight of the attached weight plates 35, the longitudinal sliding device set 31 further provides a stretcher bar 318 fixedly connected between the two links 314 in a parallel manner relative to the sliding bar 315. Of course, two or more than two stretcher bars 318 can be provided and connected between the two links 314 subject to actual requirements.

In conclusion, by means of the exercise of moving the weight-bearing mechanism 30 of the multifunctional leg training machine 10,10' toward or away from the framework 20, the weightlifting training mode is more varied, allowing the user to perform a squat exercise, a lunge exercise, a calf-raise exercise, a simple transverse body movement exercise, or a mixed training exercise of moving the body transversely and upwardly to fully train different muscle groups of the legs. In the muscle training process, the positioning mechanism 40 and the buffering mechanism 50 ensure a high level of safety and use convenience.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multifunctional leg training machine, comprising:

a framework placed on a bearing surface; and a weight-bearing mechanism mounted in said framework and movable relative to said framework in direction toward or away from said framework, said weight-bearing mechanism comprising a longitudinal sliding device set upwardly mounted in said framework and movable between opposing top and bottom sides of said framework, a transverse sliding device set slidably coupled to said longitudinal sliding device set and movable between opposing left and right sides of said framework, and a plurality of weight plates mountable at said longitudinal sliding device set to impart a downward pressure to said longitudinal sliding device set so that when a user carries said weight-bearing mechanism with the shoulders, said weight plates give a downward pressure to the user;

wherein said longitudinal sliding device set comprises two upward bars respectively upwardly affixed to opposing left and right sides of said framework, two sliding sleeves respectively sleeved onto said upward bars and respectively axially movable along said upward bars, and a sliding bar connected between said two sliding sleeves for allowing said transverse sliding device set to slide thereon;

wherein said transverse sliding device set comprises a pulley holder frame and a plurality of pulleys, said pulleys being rotatably mounted in said pulley holder frame at two opposite sides relative to said sliding bar.

2. The multifunctional leg training machine as claimed in claim 1, wherein said longitudinal sliding device set further comprises a hanging rod connected to each said sliding sleeve and extending toward said sliding bar for hanging said weight plates.

3. The multifunctional leg training machine as claimed in claim 1, wherein said transverse sliding device set further comprises a cushion set and two grips, said cushion set is fixedly mounted at said pulley holder frame for stopping at the shoulders of the user operating the multifunctional leg training machine, said grips being affixed to said pulley holder frame and respectively disposed near the user's shoulders for holding by the user.

4. The multifunctional leg training machine as claimed in claim 3, wherein said sliding bar is a rhombic tube having four slanted sides, and each two adjacent said slanted sides being connected together to create a V-shaped sliding rail; each said pulley defines therein a V-shaped sliding groove fitting said V-shaped sliding rail.

5. The multifunctional leg training machine as claimed in claim 3, wherein said cushion set comprises two pivot members and a cushion member, said pivot members being fixedly connected to a bottom side of said pulley holder frame, said cushion member being pivotally coupled between said two pivot members.

6. The multifunctional leg training machine as claimed in claim 1, further comprising two positioning mechanisms respectively mounted at said sliding bar of said longitudinal sliding device set near said framework for positioning said weight-bearing mechanism in said framework at a predetermined elevation.

7. The multifunctional leg training machine as claimed in claim 6, wherein said framework comprises two upright posts disposed at two opposite lateral sides thereof and upwardly extended from a bottom side thereof, and a plurality of positioning rods located at each said upright post at different elevations; each said positioning mechanism comprises a connection member, a handle and a hook member, said connection member being fixedly connected to said sliding bar, said handle being pivotally connected to said connection member, said hook member being biasable by said handle in two reversed directions to hook on said positioning rod or to release said positioning rod.

8. The multifunctional leg training machine as claimed in claim 7, wherein the hook members of said two positioning mechanisms are connected together by a link for enabling said two positioning mechanisms to be moved synchronously.

9. The multifunctional leg training machine as claimed in claim 6, further comprising two buffering mechanisms, each said buffering mechanism comprising a buffer sleeve, a grip and a clamping hook, said buffer sleeve being axially slidably and rotatably sleeved onto one respective said upward bar, the grip of each said buffering mechanism being fixedly connected to said buffer sleeve, said clamping hook being biasable by the grip of the respective said buffering mechanism in two reversed directions to hook on said positioning rod or to release said positioning rod.

10. The multifunctional leg training machine as claimed in claim 1, said framework further comprises two support posts disposed at two opposite lateral sides thereof and upwardly extended from a bottom side thereof, and a plurality of hanging rods located at each said support post at different elevations for hanging said weight plates.

* * * * *